US007806399B2

(12) United States Patent
Dangelewicz et al.

(10) Patent No.: US 7,806,399 B2
(45) Date of Patent: Oct. 5, 2010

(54) MEDIA SUPPORT PICK DEVICE

(75) Inventors: John A. Dangelewicz, San Diego, CA (US); Geoffrey F. Schmid, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 130 days.

(21) Appl. No.: 12/253,360

(22) Filed: Oct. 17, 2008

(65) Prior Publication Data

US 2009/0152798 A1 Jun. 18, 2009

Related U.S. Application Data

(60) Provisional application No. 61/013,214, filed on Dec. 12, 2007.

(51) Int. Cl.
*B65H 3/08* (2006.01)

(52) U.S. Cl. ..... 271/95; 271/9.06; 414/797; 198/468.4

(58) Field of Classification Search ..... 271/90, 271/95, 9.01, 9.06, 94, 106; 198/468.4; 414/416.11, 414/416.07, 752.1, 797, 796.9, 793, 797.8
See application file for complete search history.

(56) References Cited

U.S. PATENT DOCUMENTS

| | | | | |
|---|---|---|---|---|
| 4,443,099 | A * | 4/1984 | Linman et al. | 355/75 |
| 4,487,409 | A * | 12/1984 | Orii | 271/267 |
| 4,674,867 | A * | 6/1987 | Kitai et al. | 355/78 |
| 5,048,811 | A * | 9/1991 | Hochbein | 271/5 |
| 5,049,030 | A * | 9/1991 | Lockert | 414/788.7 |
| 5,315,348 | A * | 5/1994 | Hicks | 355/50 |
| 5,322,268 | A * | 6/1994 | Okutsu et al. | 271/11 |
| 5,404,197 | A * | 4/1995 | Hicks | 355/77 |
| 6,168,009 | B1 * | 1/2001 | Asai et al. | 198/468.4 |
| 6,422,801 | B1 * | 7/2002 | Solomon | 414/416.07 |
| 7,229,241 | B2 * | 6/2007 | Solomon et al. | 414/416.07 |
| 7,597,319 | B2 * | 10/2009 | Dangelewicz et al. | 271/188 |
| 7,604,231 | B2 * | 10/2009 | Yuen et al. | 271/106 |
| 2003/0017035 | A1 * | 1/2003 | Solomon et al. | 414/416.07 |
| 2006/0238561 | A1 | 10/2006 | Caecia et al. | |
| 2006/0261536 | A1 * | 11/2006 | Dangelewicz et al. | 271/90 |
| 2006/0261537 | A1 * | 11/2006 | Dangelewicz et al. | 271/106 |
| 2008/0174651 | A1 * | 7/2008 | Schmid et al. | 347/104 |

* cited by examiner

*Primary Examiner*—Kaitlin S Joerger

(57) ABSTRACT

Various apparatus and methods relating to positioning differently sized sheets on a shuttle for printing are disclosed.

19 Claims, 13 Drawing Sheets

MEDIA SUPPORT PICK DEVICE

CROSS-REFERENCE TO RELATED PATENT APPLICATIONS

This application claims the benefit of U.S. provisional patent application Ser. No. 61/013,214, filed on Dec. 12, 2007, entitled MEDIA SUPPORT PICK DEVICE. The present application is related to co-pending U.S. patent application Ser. No. 12/253,388 filed on the same day herewith by Dale D. Timm, John A. Dangelewicz, David H. Donovan, Shilin Guo, Behnam Bastani and David Luis Pereira and entitled DOUBLE-SIDED PRINTING SYSTEM, the full disclosure which is hereby incorporated by reference. The present application is related to co-pending U.S. patent application Ser. No. 12/253,321 filed on the same day herewith by John A. Dangelewicz and Dale D. Timm, Jr. and entitled TRAY SURFACE CLEANING DEVICE, the full disclosure which is hereby incorporated by reference. The present application is related to co-pending U.S. patent application Ser. No. 11/625,032 filed on Jan. 19, 2007 by Geoffrey F. Schmid and Kevin T. Kersey an entitled VACUUM RELIEF, the full disclosure which is hereby incorporated by reference. The present application is related to co-pending U.S. patent application Ser. No. 11/133,539 filed on May 20, 2005 by John A. Dangelewicz, Kevin T. Kersey, Timothy J. Carlin, Geoffrey F. Schmid and Michael A. Novick an entitled SHEET HANDLING, the full disclosure which is hereby incorporated by reference.

BACKGROUND

Some printers may provide the ability to print on differently sized sheets of media. To do so, such printers may either require a person to manually exchange supplies of different sized media or may require multiple media paths. As a result, such printers have increased size, complexity and cost.

DETAILED DESCRIPTION OF THE EXAMPLE EMBODIMENTS

Figure 1:
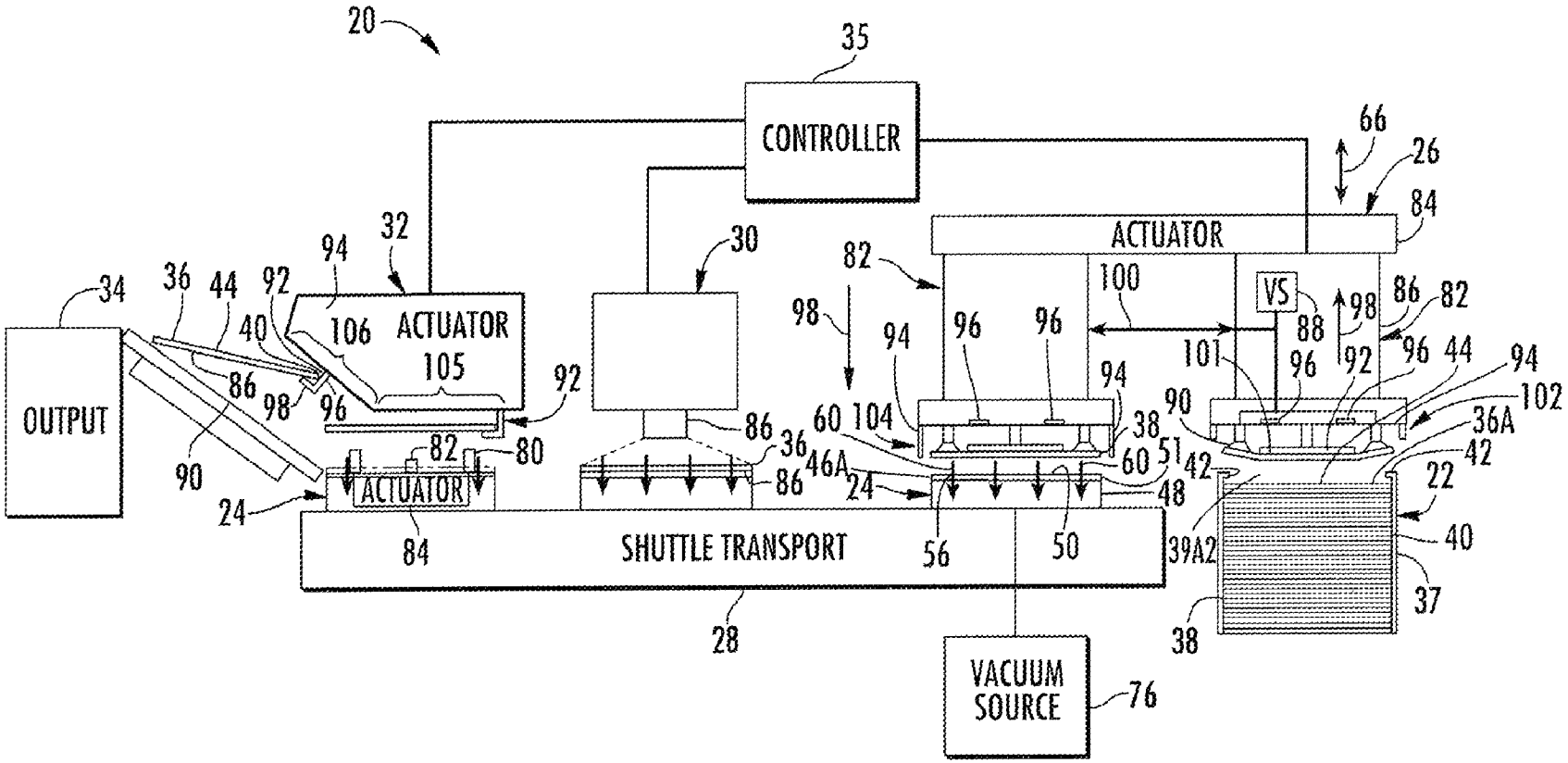
FIG. 1 is a schematic illustration of a printing system according to an example embodiment.
Figure 2:
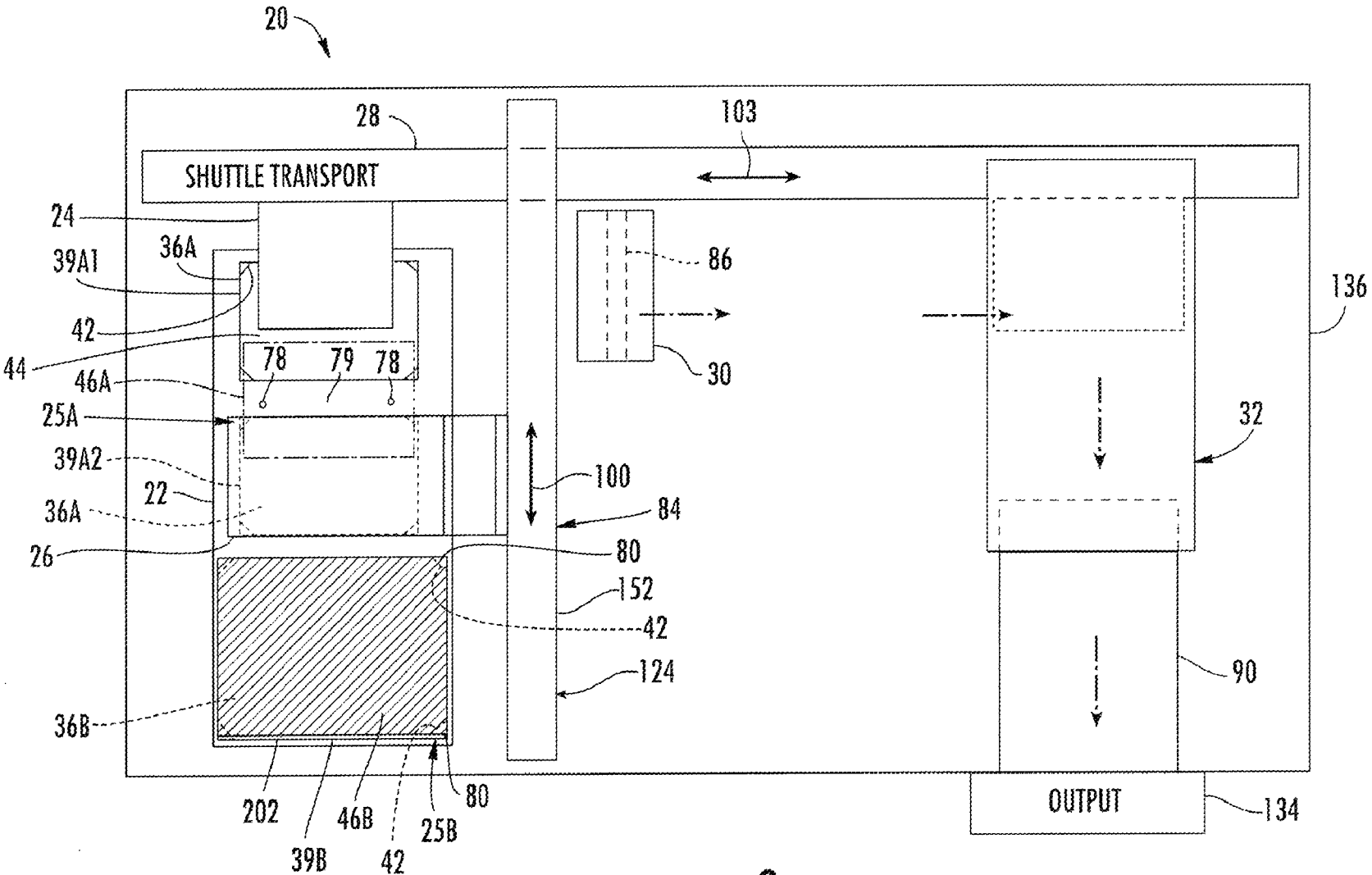
FIG. 2 is a top plan view schematically illustrating the printing system of FIG. 1 according to an example embodiment.

FIGS. 1 and 2 schematically illustrate sheet printing system 20 according to an example embodiment. System 20 is configured to print or otherwise deposit material upon different dimensioned or sized sheets of media using a single media path. As a result, the size, complexity and cost of system 20 are reduced.

Sheet printing system 20 generally includes sheet supply station 22, shuttle tray 24 (shown at three positions), parking spots 25A, 25B (collectively referred to as parking spots 25), pick device 26, shuttle transport 28, print station 30, off-load station 32 and output 34. Sheet supply station 22 stores and supplies differently sized individual sheets 36A, 36B (shown in FIG. 2) (collectively referred to as sheets 36). Sheet supply station 22 comprises one or more magazines including one or more sidewalls 37 which form stack cavities 39A1, 39A2 (collectively referred to as cavities 39A) and 39B (all of cavities 39A1, 39A2 and 39B collectively referred to as cavities 39). Cavities 39 receive and contain stacks of differently sized sheets of media. Sidewalls 37 further engage edges 40 of sheets 36 to align sheets 36 such that sheets 36 are consistently positioned with respect to pick device 26. In the example illustrated, sheet supply station 22 includes a single magazine containing multiple differently sized sheets of media, facilitating easier replenishment of sheets. In other embodiments, station 22 may include multiple distinct magazines.

As shown by FIGS. 1 and 2, sheet supply station 22 additionally includes projections 42. Projections 42 extend above a top face 44 and across the corners of the uppermost sheet 36 of the stack of sheets 36. Projections 42 contact corners above sheets 36 as sheets 36 are being lifted from station 22 by pick device 26 to reduce the likelihood of multiple sheets 36 sticking to one another and being concurrently picked. In other embodiments, projections 42 may be omitted.

Figure 3:
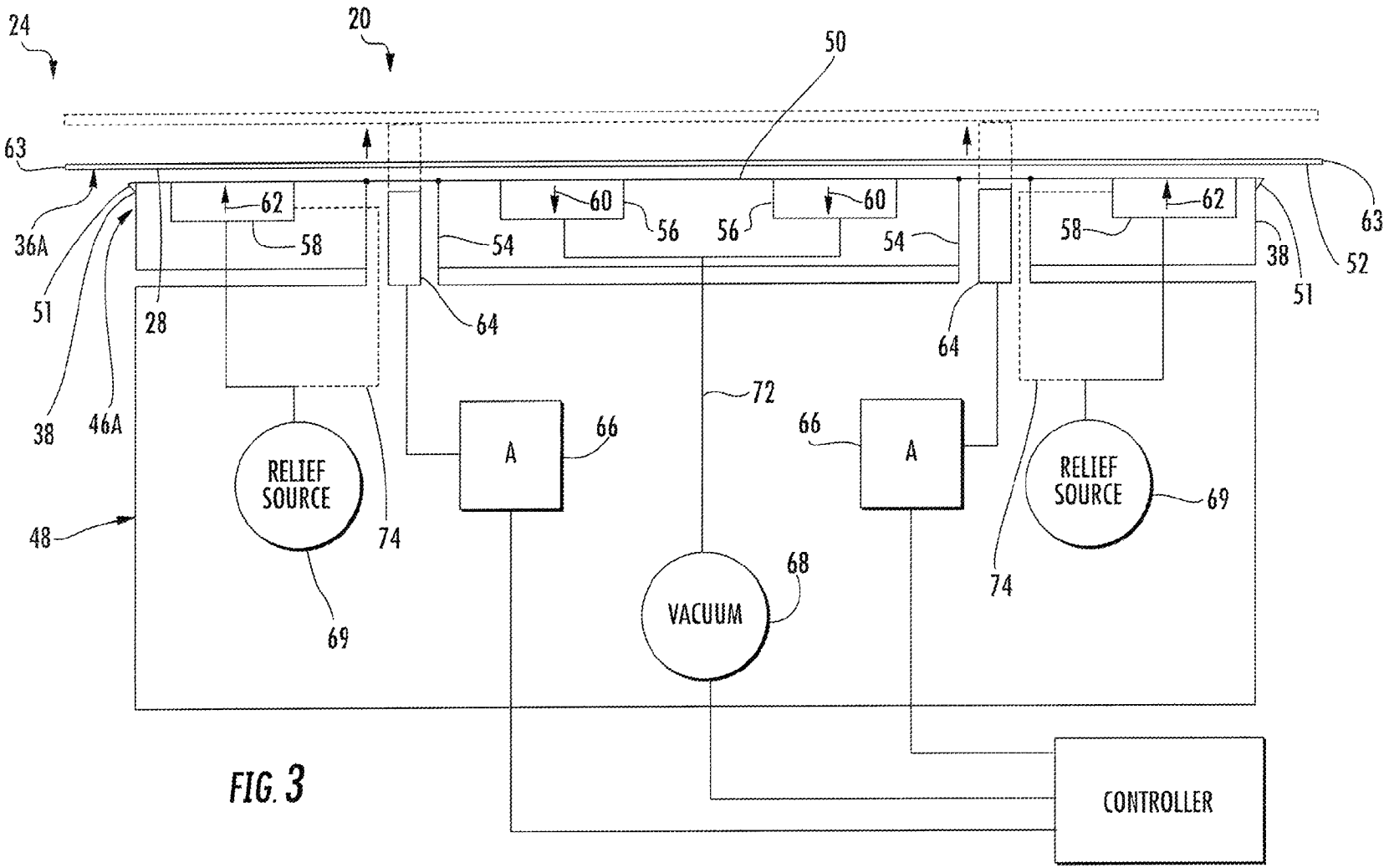
FIG. 3 is a section view schematically illustrating a shuttle tray of the printing system of FIG. 1 according to an example embodiment.

Shuttle tray 24 comprises a member configured to support and hold one of the differently sized sheets 36 of media as the sheet is transported from to print station 30 and to off-load station 32. Shuttle tray 24 includes interchangeable media supports 46A (shown in FIG. 1) and 46B (shown in FIG. 2) (collectively referred to as media supports 46) and base 48. FIG. 3 schematically illustrates base 48 in more detail. Although FIG. 3 illustrates base 48 supporting media support 46A and sheet 36A, base 48 may alternatively support media support 46B and sheet 36B.

Media supports 46 comprise plates or other structures configured to support a sheet of media and to facilitate edge-to edge printing upon the sheet. Each of supports 46 has a length and a width configured for a particular size of sheet such that the edges of the supported sheet extend beyond the underlying support 46A, 46B but do not substantially wilt, droop or bend. As a result, the printing material does not become substantially deposited upon support 46A or support 46B (shown in FIG. 2) where the printing material may subsequently be transferred to the underlying surface of a subsequent sheet. Because the edges are sufficiently supported so as to not substantially droop, print quality is maintained along the edges.

According to one example embodiment, support 46A is configured to support a 4×6 sheet of media while support 46B (shown in FIG. 2) is configured to support a 5×7 sheet of media. According to one embodiment, such supports 46 are configured to support such sized sheets of photo media. Accordingly, support 46A has a width slightly less than 4 inches and a length slightly less than 6 inches. Support 46B (shown in FIG. 2) has a width slightly less than 5 inches and a length slightly less than 7 inches. According one embodiment, support 46A has dimensions of 3.75 inches by 5.75 inches while support 46B has dimensions of 4.75 inches by 6.75 inches. In other embodiments, supports 46 may have other dimensions which are different from one another.

Each of media supports 46A, 46B has an upper surface 50 terminating at edges 38. In the particular embodiment shown, support 30 additionally includes an elongate gasket or seal 51 comprising a resilient elastomeric lip extending about edge 38 up into abutment with a lower surface 52 of sheet 36A. Seal 39 provides a barrier against the flow of aerosols between support 46A and sheet 36A. In other embodiments, seal 51 may be omitted.

In the particular example illustrated, each of supports 46A, 46B is further configured to facilitate removal or unloading of sheets from supports 46A, 46B and to also facilitate more secure retention of sheets upon supports 46. In the particular example illustrated, each of supports 46 includes lifter openings 54, vacuum ports 56 and vacuum reliefs 58. Lifter openings 54 extend through support 46A at one or more locations along supports 46A. Lifter openings 54 permit movement of lifters 64 from below to above support 46A, 46B. Although two lifter openings 54 are illustrated in FIG. 3, in other embodiments, a greater or fewer of such lifter openings 54 may be provided in each of support 46A, 46B.

Vacuum ports 56 comprises openings, depressions, channels, gaps, grooves or other voids along supports 46A, 46B through which a vacuum force (schematically represented by arrows 60) is applied to an opposite sheet 36A. Although vacuum system 50 is illustrated as including two spaced ports 56, in other embodiments, a greater or fewer of such ports 56 may be provided.

Vacuum reliefs 58 comprise recesses, depressions, gaps, channels, grooves, cavities or other voids along surface 50 of each of supports 46A, 46B through which air or other gases at a pressure less negative than the negative pressure applied by vacuum ports 56 (schematically represented by arrows 62) is applied to sheet 36A or sheet 36B. Vacuum reliefs 58 extend in close proximity to edges 38 of supports 46A, 46B such that vacuum pressure is relieved proximate to edges 38. Vacuum reliefs 58 are located between edge 38 and vacuum ports 56. Vacuum reliefs 58 relieve or reduce the vacuum along support 46A of support 30 proximate to edges 38 of support 30 and proximate to edges 26 of sheet 36A. As a result, potentially aerosol containing air is less likely to be drawn to the underside of sheet 36A along edges 63.

According to one embodiment, vacuum relief 66 are spaced from edges 38 by less than or equal to about 1.5 mm. In one embodiment, vacuum reliefs 58 may comprise one or more continuous elongate channels extending a proximate to edges 38. In still other embodiments, vacuum reliefs 58 may comprise a multitude of spaced depressions, each depression in communication with a relief source 69. In yet other embodiments, vacuum reliefs 58 may have other configurations or may be omitted.

Base 48 comprises an arrangement of components or structures coupled to shuttle transport 28 and configured to carry one of supports 46A, 46B. In the particular example illustrated, base 48 includes lifters 64, actuators 66, vacuum 68 and relief source 69.

Lifters 64 comprise structures configured to pass through lifter openings 54 of supports 46A, 46B and separate or release sheet 36A, 36B from the support 46A, 46B and to facilitate removal of one of sheets 36 from support 46A, 46B. In the particular example illustrated, lifters 64 comprise fingers or other projections which or movable between a retracted position (shown in solid lines) in which lifters 64 are level with the support 46A or are recessed below support 46A within lifter openings 54 and an extended position (shown in broken lines) in which lifters 64 engage face 28 of sheet 36A and support and space sheet 36A above support 46A. Although base 48 is illustrated as including two lifters 64, in other embodiments, base 48 may include a greater or fewer of such lifters 64.

Actuators 66 comprise mechanisms configured to selectively move lifters 64 between the retracted and the extended positions. In the particular example illustrated, actuators 46 move lifters 64 to lift sheet 36A from a lowered position (shown in solid lines) in which sheet 36A rests upon support 46A to a raised position (shown in broken lines). By lifting sheet 36A to the raised position, media release system 32 facilitates engagement with an underside or lower face 52 of sheet 36A and edges 63 of sheet 36A with a hook, claw, catch, truck or other sheet withdrawing mechanism at off-load station 32. As a result, sheet 36A may be withdrawn from support 46A, 46B with reduced or no contact with the face 24 upon which material has been deposited, reducing undesirable marking or smears upon face 24. In those embodiments in which vacuum pressure is maintained by base 48 and the support 46A during removal of sheet 36A from support 30, lifting of sheet 36A additionally breaks the vacuum hold to facilitate removal of sheet 36A.

In one embodiment, actuators 66 pivot lifters 64 between the retracted and extended positions. In another embodiment, actuators 66 linearly move lifters 64 between the raised and lowered positions. In one embodiment, actuators 66 may comprise linear actuators such as hydraulic or pneumatic cylinder-piston assemblies or solenoids. In other embodiments, actuators 66 may comprise a rotary actuator and one or more appropriate cams. Although each of the lifters 64 is illustrated as having a dedicated actuator 46 independently controllable so as to independently actuate lifters 64, in other embodiments, a single actuator may be operably coupled to both lifters 64 to concurrently move lifters 64.

Vacuum source 58 comprises a device, such as a pump, configured to create a vacuum within each of ports 56. In one embodiment, vacuum source 58 creates a vacuum such that each of ports 56 has a pressure less than atmospheric pressure. According to one embodiment, vacuum source 58 includes vacuum manifold 72 underlying support 46A. Vacuum manifold 72 forms a vacuum chamber below ports 56. In other embodiments, ports 56 may be pneumatically connected to independent vacuum sources such that different vacuum pressures may be applied to different ports 56.

According to one embodiment, ports 56 and vacuum source 58 are configured so as to create a pressure of at least about 40 inches $H_2O$ and nominally about 80 inches $H_2O$ (3 PSI) and each of ports 56. In other embodiments, other negative pressures sufficient to retain sheet 36A against support 30 may be utilized.

Relief sources 68 comprise one or more sources of air or gas having a pneumatic pressure greater than the negative pressure applied by vacuum source 58 at each of ports 56. According to one embodiment, relief sources 68 comprise pneumatic passages or vents pneumatically connecting vacuum reliefs 58 to air at atmospheric pressure. For example, relief sources 68 may comprise vents extending from each of reliefs 58 to the a volume of air which is at atmospheric pressure, in one embodiment, the volume of air at atmospheric pressure may be a volume of layer beneath support 30. As a result, substantially clean air or air less likely to contain aerosols from deposition device 31 is provided through vacuum reliefs 58. In addition, the extent of piping, conduit or other structures to direct such air to reliefs 58 may be minimized due to the reduced distance between the source of air and vacuum reliefs 58.

As indicated by broken lines 74, in one embodiment, relief sources 68 may be provided by one or more pneumatic passages which extend from below support 30 at least partially through openings and 42 to vacuum reliefs 58. For example, lifter openings 54 may be in pneumatic communication with the underside of base 48. Additional channels or grooves along support 46A or tubes or tunnels formed or provided within support 46A, 46B extending from opening 42 to the one or more vacuum reliefs 58 may be utilized to provide air at atmospheric pressure from the underside of base 48. As a result, opening 42 may have a dual purpose, reducing cost and complexity of system 20. In other embodiments, relief sources 68 may be distinct from lifter openings 54. Although vacuum relief system 52 is illustrated as having two vacuum reliefs 58 connected to independent relief sources 68, in other embodiments, a greater or fewer of such vacuum reliefs may be provided. Moreover, one or more of vacuum reliefs 58 may share a common relief source 69.

Parking spots 25 comprise one or more structures configured to support one or more of media supports 48 when such media supports 48 are not on base 48 and are not being used. Parking spots 25 extend along upper portions of sheet supply 22 and elevate or support media supports 48, when not in use, at least partially over and across stack cavities 39A and 39B. In particular, as shown by FIG. 2, parking spot 25A is configured to support media support 46A (depicted by broken lines) between and over adjacent similarly sized stack cavities 39A which are configured to receive stacks of sheets 36A. Parking spot 25B is configured to support media support 46B substantially over stack cavities 39B. Because parking spots 25 support their associated media supports 46 at least partially over stack cavities 39, valuable space in system 20 is preserved. At the same time, parking spots 25 facilitate access to and retrieval of unused media supports 46 by pick device 26 for fast and efficient exchanging of differently sized media supports on base 48 without having to move pick device 26 along an additional path to retrieve a different media support 46 or to store and exchanged media support 46. In other words, parking spots 25 enable pick device 26 to use the same path to travel for both retrieving and storing media supports 46 and for picking both sizes of sheets 36.

In the example illustrated, parking spots 25 include one or more retaining elements configured to secure and retain media supports 46 against horizontal movement when such support 46 are positioned at parking spots 25. For example, in one embodiment, retaining elements may comprise corresponding projections and detents that receive such projections to retain support 46A, 46B against horizontal movement.

In the particular example illustrated, parking spot 25A includes a pair of retaining elements 78 supported on an intermediate crossbeam 79 extending between the consecutive stack cavities 39A. In one embodiment, retaining elements to 78 comprise locating holes or detents configured receive corresponding projections extending from a lower side of media support 46A. Parking spot 25B includes a pair of retaining elements 80 above a pair of projections 42. In one embodiment, retaining element 80 comprises a pair of projections, such as pins, configured to be received by a corresponding pair of detents or openings along an underside of media support 46B. In other embodiments, retaining elements 78 and 80 may have other configurations and may be provided at other locations.

Pick device 26 comprises a mechanism configured to pick the uppermost sheet 36A, 36B from sheet supply station 22 and to deposit the picked sheet 36A, 36B upon one of media supports 46A, 46B of shuttle tray 24. Pick device 26 is further configured (1) to remove one of media supports 46A, 46B from base 48, (2) to position or park the removed the media support at the appropriate one of parking spots 25A, 25B, (3) to pick the other of media supports 46A, 46B from its parking spot 25A, 25B and (4) to position the other media support 46A, 46B upon base 48. As shown by FIG. 1, pick device 26 includes pick unit 82 and actuator 84 (shown at two positions in FIG. 1).

Pick unit 82 grasps or secures articles (sheets 36 or supports 46) and raises and lowers such articles with respect to sheet supply station 22, parking spots 25 and base 48 of shuttle tray 24. Pick unit 82 includes body 86, vacuum source 88, vacuum cups 90, pressure member 92, pushers 94 and support grabbers 96. Body 86 is coupled to actuator 84 and generally houses and supports the remaining components of pick unit 82. Vacuum source 88 comprises a device configured to create a vacuum for each of vacuum cups 90. In one embodiment, vacuum source 88 comprises a blower carried by body 86 and in communication with cavities of vacuum cups 90. In other embodiments, other vacuum sources may be utilized.

Vacuum cups 90 generally comprise members extending from body 86 in communication with vacuum source 88 and configured to substantially seal against top face 44 of a sheet 36 while applying a vacuum to top face 44 so as to hold a sheet 36 against cups 90. Vacuum cups 90 are peripherally located about pressure member 92. In one embodiment, pick unit 82 includes four vacuum cups 90 configured to contact top face 44 of sheet 36 proximate to the four corners of sheet 36. In other embodiments, pick unit 82 may include a greater or fewer of such vacuum cups at other locations.

Pressure member 92 comprises a member having a surface 101 supported by and movable relative to body 86 between an extended position in which surface 101 extends beyond cups 90 and a retracted position in which surface 101 is substantially even with or withdrawn relative to the terminal portions of cups 90. Pressure member 92 is further configured such that surface 101 is resiliently biased towards the extended position. In the example shown, surface 101 is centrally located between vacuum cups 90 so as to generally contact the central portion of face 44 of a sheet 36 of media when picking a sheet of media.

Pushers 94 comprise feet or other structures movably supported by body 86 so as to move between a retracted position 102 and an extended position 104. In the retracted position, pushers 102 are withdrawn from a top face of every sheet 36 held by cups 90. In the extended position, pushers 102 engage and press against portions of the top face of the sheet 36 held by cups 90.

Pushers 94 are located to an outside of each of the suction cups 90. In other words, each pusher 94 is spaced from a center point between suction cups 90 by a distance greater than the distance at which the cup most proximate to the pusher is spaced from the center point. In the example illustrated, cups 90 are configured to engage surface portions proximate to corners of sheets 36A while pushers 90 are outside the edges 38 of the smaller sheets 36A. However, pushers 94 are configured to engage surface portions of the larger sheets 36B outside cups 90. As a result, during positioning of a sheet 36B upon media support 46B, pushers 94 press the outside corners of sheets 36B against media support 46B to enhance vacuum retention of the sheet 36B against the support 46B.

Support grabbers 96 comprise one or more mechanisms configured to secure or grip one of supports 46, enabling device 26 to lift and carry support 46A 46B. According to one example embodiment, grabbers 96 comprise selectively actuatable electromagnets, wherein supports 46 include ferrous portions. In such embodiments, the electromagnetic grippers may grasp supports 46 over portions of supports 46 which include vacuum ports or relief ports. In other embodiments, grabbers 96 include suction cups. In yet embodiments, grabbers 96 may comprise other mechanisms configured to grab, grip or otherwise secure a support 46A, 46B for lifting and carrying of the support.

Actuator 84 generally comprises a mechanism configured to move pick unit 82. In the particular example shown, actuator 84 is configured to raise and lower pick unit 82 relative to sheet supply station 22 as indicated by arrows 98. Actuator 84 is also configured to move pick unit 82 in the direction indicated by arrows 100 between a position generally opposite to sheet supply station 22 and another position generally opposite to shuttle tray 24. Actuator 84 may comprise a hydraulic or pneumatic cylinder-piston assembly, an electric solenoid, a motor and a transmission including one or more belts, pulleys, gear assemblies or cams or other mechanisms to actuate or move pick unit 82.

In response to receiving control signals from controller 35, actuator 84 lowers pick unit 82 towards an uppermost sheet 36 at sheet supply station 22 while surface 62 is in the extended position. As a result, surface 101 will initially contact top face 44 of an uppermost sheet 36. Continued lowering of pick unit 82 by actuator 84 results in surface 101 being moved to the retracted position as vacuum cups 90 are brought into contact with face 44 of sheet 36. In response to receiving signals from controller 35, vacuum source 88 applies a vacuum through vacuum cups 90 such that the uppermost sheet 36 is grasped. Thereafter, actuator 84 lifts pick unit 82 which results in the held sheet 36 also being lifted. During such lifting, surface 62 resiliently returns to its extended position, resulting in the corners of sheet 36 gripped by the vacuum of vacuum cups 90 being upwardly bent or curved to peel the uppermost sheet 36 from underlying sheets 36 at sheet supply station 22.

As pick unit 82 is lifted, the corners of the uppermost sheet 36 grasped by pick unit 82 engage projections 42. Projections 42 temporarily bend or deform the corners of such sheets 36 in a downward direction as pick unit 82 is lifted. Once the corners of the grasped sheet 36 have been lifted beyond projections 42, the corners resiliently return to an upward orientation, creating a breaking away force between the grasped sheet 36 and any underlying sheet 36 which may be adhering to the grasped sheet 36.

After actuator 84 has moved unit 82 along one or more horizontal guides (not shown) to the leftward most position shown in FIG. 1 opposite to one of supports 46, actuator 84 lowers the sheet 36A, 36B onto the support 46. At such time, a vacuum is applied thru ports 56, drawing the sheet against support 46. When support 46B is upon base 48 and when sheet 36B is being placed, pushers 104 press the corners of the larger sheet to enhance vacuum retention of the corners.

When a differently sized sheet is to be printed upon, controller 35 generates control signals such that pick device 26 lifts the current support 46 from the base and parks it at the assigned parking spot 25. Pick device then lifts the other support 46 from its parking spot and positions it upon base 48. Thereafter, pick device 26 picks and places the differently sized sheet upon the support 46A, 46B.

Shuttle transport 28 comprises a mechanism configured to move shuttle tray 24 between pick unit 82, print station 30 and off-load station 32. In one embodiment, shuttle transport 28 comprises an endless belt or chain coupled to shuttle tray 24 and configured to move shuttle tray 24 along the guides as a rod, bar or support surface. In another embodiment, shuttle transport 28 may comprise a motor and screw mechanism, a motor and rack and pinion mechanism, a hydraulic or pneumatic piston-cylinder assembly, an electric solenoid or other mechanisms configured to linearly translate shuttle tray 24 in directions indicated by arrows 103 (shown in FIG. 2).

Print station 30 comprises a station at which media 36 supported by shuttle tray 24 is interacted upon. In the embodiment shown, print station 30 is configured to deposit fluid, such as ink, upon top face 44 of sheet 36. In the example shown, fluid is deposited upon face 44 while sheet 36 is held by vacuum applied through vacuum ports 56 as indicated by arrows 60. In the particular embodiment illustrated, print station 30 includes a print device 86 configured to deposit fluid, such as ink, across substantially the entire face 44 during a single pass of shuttle tray 24 relative to print station 30. In another embodiment, print station 30 and print device 86 may alternatively be configured to be moved or scanned relative to surface 44 of sheet 36. In one embodiment, print device 86 comprises one or more inkjet print heads. In other embodiments, print device 86 may comprise other devices configured to deposit fluid upon face 44 or to otherwise form an image upon face 44 of sheet 36.

Off-load station 32 is configured to remove the printed upon sheet 36 from shuttle tray 24 and to transport the removed sheet to output 34. Off-load station 32 generally includes slide 90, trucks 92 and actuator 94. Slide 90 comprises a surface extending between shuttle tray 24 and output 34. In the particular example shown, slide 90 is inclined so as to form an upwardly extending ramp from shuttle tray 24 to output 34. As a result, output 34 may be positioned at a higher location to facilitate removal of printed upon sheets. In other embodiments, slide 90 may be supported at other orientations.

Trucks 92 comprise structures configured to engage and move a printed upon sheet 36 from shuttle tray 24 along slide 90 to output 34. Each truck 92 generally includes a leg 96 and a foot 98. Leg 96 extends from actuator 94 and is generally configured to engage or contact edge 40 of sheet 36. Foot 98 extends from leg 96 and is configured to extend along and contact a bottom face 86 of sheet 36. In the example illustrated, station 30 to utilize a series of trucks 92 arranged in pairs and spaced from one another so as to be configured to engage both sheets 36A and 36B. As a result, each truck 92 engages sheet 96 without substantially contacting printed upon face 44 to reduce the likelihood of smearing, scratching or otherwise damaging printed upon face 44 of sheet 36A, 36B.

Trucks 92 are configured to move along a sheet removing path 100 and along a sheet transporting path 102. When moving along the sheet removing path 100, trucks 92 push sheet 36 in a generally horizontal direction across lifters 80, 82 onto slide 90. When moving along the sheet transporting path 102, trucks 92 push sheet 36 along slide 90 into output 34.

Actuator 94 comprises a device configured to move trucks 92 along the sheet removing path 100 and the sheet transporting path 102 in response to control signals from controller 35. In one embodiment, actuator 94 comprises an endless belt, chain or web coupled to each of trucks 92 and driven by a motor or other torque source to move trucks 92 along paths 105, 106. In other embodiments, actuator 94 may have other configurations and may utilize other sources such as hydraulic or pneumatic piston-cylinder assemblies, solenoids and the like to move trucks 92 along paths 105, 106.

Output 34 generally comprises a structure configured to receive and potentially store printed upon sheets 36 until retrieved. In one embodiment, output 34 may comprise a tray. In another embodiment, output 34 may comprise a bin.

Controller 35 generally comprises a processing unit configured to generate control signals which are communicated to pick device 26, shuttle tray 24, shuttle transport 28, print station 30 and off-load station 32 to direct the operation of such devices or stations. For purposes of this disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 35 is not limited to any specific combination of hardware circuitry and software, nor to any particular source for the instructions executed by the processing unit.

According to one example embodiment, controller 35 generates control signals initially directing pick device 26 to pick and deposit a sheet 36 upon shuttle tray 24 as described in detail above. Thereafter, controller 35 generates control signals directing vacuum source 76 to apply a vacuum through ports 74 to the sheet 36 placed upon shuttle tray 24 and directs shuttle transport 28 to transfer shuttle tray 24 to print station 30. Once shuttle transport 26 and the sheet 36 it carries are positioned opposite print station 30, controller 35 generates control signals directing print device 86 to deposit fluid, such as ink, upon face 44 of sheet 36 while vacuum source 76 continues to hold sheet 36 in place by applying a vacuum through ports 74. Upon completion of the deposition of fluid upon face 44 of sheet 36, controller 35 generates further control signals directing shuttle transport 28 to transfer shuttle tray 24 to off-load to a position opposite off-load station 32. Upon positioning of shuttle tray 24 at off-load station 32, controller 35 generates control signals directing actuator 84 to move lifters 80, 82 to their extended positions and to optionally cease or reduce the application of vacuum by vacuum source 76.

Controller 35 further generates control signals directing actuator 94 to drive trucks 92 such that trucks 92 engage bottom 86 and edge 40 to move sheet 36 off of lifters 80, 82 and onto slide 90. In one embodiment, actuator 94 moves the off-loaded sheet 36 into output 34 without an interruption. In another embodiment, actuator 94 may temporarily pause with an off-loaded sheet 36 resting upon slide 90 while fluid or printing material dries or otherwise solidifies upon surface 44. After a predetermined period of time, actuator 94 continues operation to continue to drive trucks 92 to move the sheet 36 to output 34.

As shown by FIG. 1, pick actuator 84 of pick device 26 is configured to move pick unit 82 along and over the top of each of stack cavities 39 of sheet supply station 22 in the direction indicated by arrows 100. Once a sheet 36 is picked by pick unit 82, actuator 84 moves pick unit 82 and the grasped sheet 36 in the direction indicated by arrow 100 to a position over magazine sheet stack 39A. In the particular example shown, shuttle tray 24 is movable to a position above the same magazine stack 39A of sheet supply station 22 and between stack 39A1 and pick unit 82. As a result, a sheet 36 carried by pick unit 82 (shown in FIG. 1) may be deposited upon shuttle tray 24 while pick unit 82 is positioned above both shuttle tray 24 and stack cavity 39A1. In a scenario where a sheet 36 is to be picked from stack cavity 39A1, shuttle tray 24 is initially moved out from above cavity 39A, pick unit 82 then picks a sheet 36 from cavity 39A1 and shuttle tray 24 is then moved between cavity 39A1 and pick unit 82 for receiving the sheet 36. Because shuttle tray 24 is configured to receive a picked sheet 36 from pick unit while shuttle tray 24 is over cavity 39A1, the overall architecture of printing system 20 occupies less space and is more compact.

As further shown by FIG. 2, shuttle transport 28 moves shuttle tray 24 along an axis generally perpendicular to an axis along which pick unit 82 is moved and perpendicular to the arrangement of stack cavities 39. As a result, the overall length of station 22 is reduced and the shorter dimension or width of each sheet 36 passes beneath print station 30 or with a shorter scan length. In other embodiments, the arrangement between stack cavities 39, pick device 26, shuttle tray 24 and shuttle transport 28 may have other configurations.

FIGS. 4-16 illustrate printing system 120, another embodiment of printing system 20. Printing system 120 is similar to printing system 20 in that printing system 120 also includes sheet supply station 22, shuttle transport 28, printing station 30, off load station 32 and controller 35, each of which is shown and described above with respect to FIGS. 1 and 2. Printing system 120 is different from printing system 20 in that printing system 120 specifically includes shuttle tray 124, parking spots 125A, 125B (collectively referred to as parking spots 125) and pick device 126 in place of shuttle tray 24, parking spots 25 and pick device 26, respectively. The remaining elements of printing system 120 which correspond to similar elements of printing system 20 are numbered similarly.

FIGS. 4-8 illustrate shuttle tray 124. Shuttle tray 124 includes interchangeable media supports 146A, 146B (collectively referred to as media supports 146) and shuttle base 148 (a portion of which is shown). Media supports 146 each comprise a plate which serves as a platform for supporting a sheet of media. Each of supports 146 has a length and a width configured for a particular size of sheet such that the edges of the supported sheet extend beyond the underlying support 146A, 146B but do not substantially wilt, droop or bend. As a result, the printing material does not become substantially deposited upon support 146A or support 146B where the printing material may subsequently be transferred to the underlying surface of a subsequent sheet. Because the edges are sufficiently supported so as to not substantially droop, print quality is maintained along the edges.

According to one example embodiment, support 146A is configured to support a 4×6 sheets of media while support 146B (shown in FIG. 2) is configured to support a 5×7 sheet of media. According to one embodiment, such supports 146 are configured to support such sized sheets of photo media. Accordingly, support 146A has a width slightly less than 4 inches and a length slightly less than 6 inches. Support 146B as a width slightly less than 5 inches and a length slightly less than 7 inches. According one embodiment, support 146A has dimensions of 3.75 inches by 5.75 inches while support 146B has dimensions of 4.75 inches by 6.75 inches. In other embodiments, supports 46 may have other dimensions which are different from one another.

Each of media supports 146A, 146B has an upper surface 150 terminating at edges 138. Like media supports 46, each of supports 146A, 146B is further configured to facilitate removal or unloading of sheets from supports 146A, 146B and to also facilitate more secure retention of sheets upon supports 146. In the particular example illustrated, each of supports 146 includes lifter openings 154, vacuum ports 156 and vacuum reliefs 158. Lifter openings 154 extend through support 146A, 146B at one or more locations along supports 146A, 146B. Lifter openings 154 permit movement of lifters 64 (shown FIG. 3) from below to above support 146A, 146B. Although four lifter openings 154 are illustrated in each of supports 146, in other embodiments, a greater or fewer of such lifter openings 154 may be provided in each of support 146A, 146B.

Vacuum ports 156 comprises openings, depressions, channels, gaps, grooves or other voids along supports 146A, 146B through which a vacuum force is applied to an opposite one of sheets 36 (shown in FIG. 2).

Vacuum reliefs 158 comprise recesses, depressions, gaps, channels, grooves, cavities or other voids along surface 150 of each of supports 146A, 146B through which air or other gases at a pressure less negative than the negative pressure applied by vacuum ports 156 is applied to sheet 136A or sheet 136B. Vacuum reliefs 158 extend in close proximity to edges 138 of supports 146A, 146B such that vacuum pressure is relieved proximate to edges 138. Vacuum reliefs 158 are located between edge 138 and vacuum ports 156. Vacuum reliefs 158 relieve or reduce the vacuum along support 146A of support 130 proximate to edges 138 of support 130 and proximate to edges 63 of sheets 36A, 36B. As a result, potentially aerosol containing air is less likely to be drawn to the underside of sheet 36A along edges 63.

According to one embodiment, vacuum reliefs 166 are spaced from edges 138 by less than or equal to about 1.5 mm. In one embodiment, vacuum reliefs 158 may comprise one or more continuous elongate channels extending a proximate to edges 138. In still other embodiments, vacuum reliefs 158 may comprise a multitude of spaced depressions, each depression in communication with a relief source 169. In yet other embodiments, vacuum reliefs 158 may have other configurations.

Figure 7:
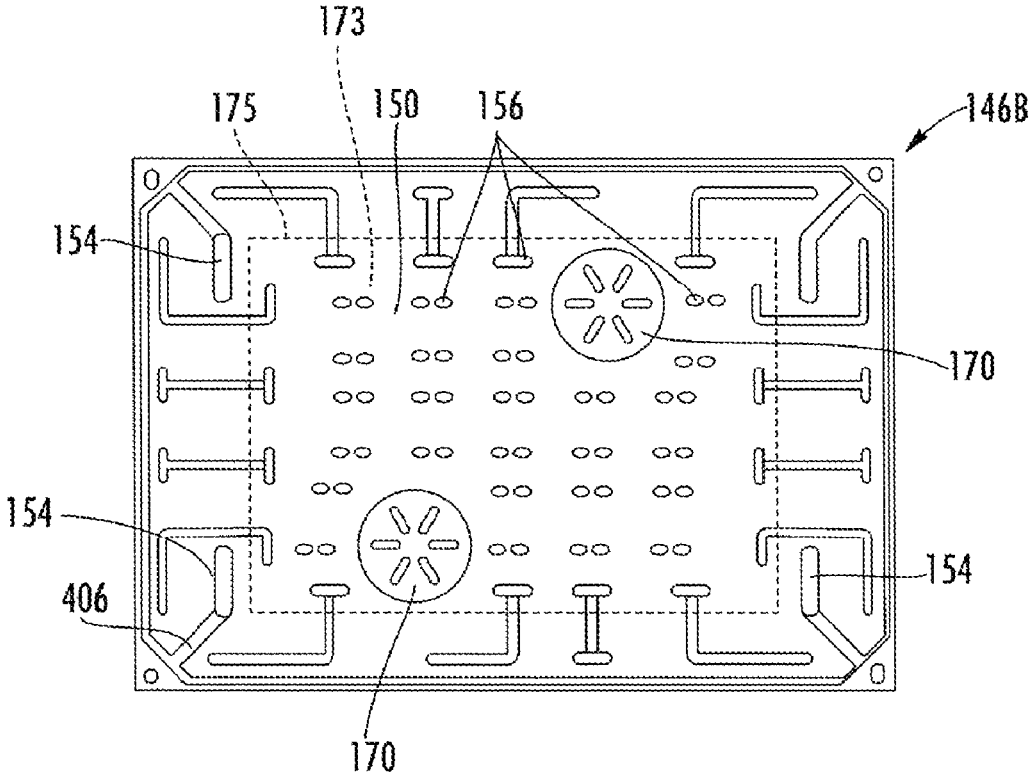
FIG. 7 is a top plan view of one of the media supports of FIG. 4 according to an example embodiment.
Figure 8:
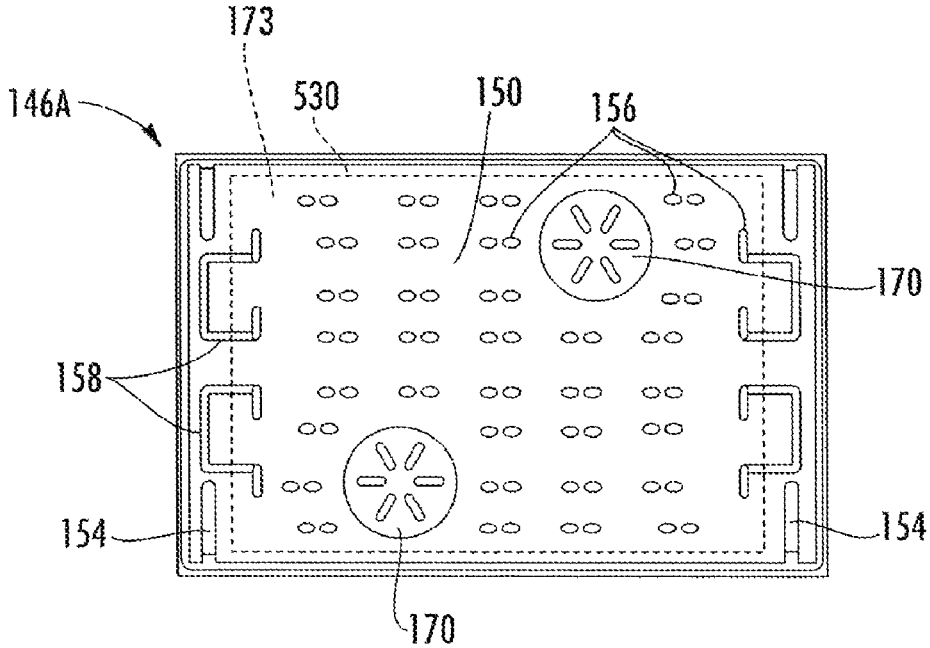
FIG. 8 is a top plan view of the other of the media supports of FIG. 4 according to an example embodiment.

As further shown by FIGS. 7 and 8, each of supports 146A, 146B additionally includes magnetic pick portions 170. Magnetic pick portions 170 comprise magnetic or ferrous material portions along surface 150 or in sufficient proximity to surface 150 such that supports 146 may be magnetically grabbed or picked by picked device 126 (shown in FIG. 14. Although each of supports 146 is illustrated as including two spaced pick portions 170 which are generally circular in shape, and other embodiments, supports 146 may alternatively include a greater or fewer of such pick portions at the same or different locations.

Base 148 is similar to base 48 (shown in FIG. 3) in that base 148 comprises an arrangement of components or structures coupled to shuttle transport 28 (shown in FIG. 1) and configured to carry one of supports 146A, 146B. Like base 48, base 148 includes lifters 64, actuators 66, vacuum 68 and relief source 69, each of which is shown in FIG. 3. Base 148 further includes manifold 172, a particular embodiment of manifold 72 (shown in FIG. 3).

Manifold 172 comprises a chamber 173 formed within and between openings 154 through which lifters 64 (shown in FIG. 3) extend. Manifold 172 is formed by gasket or seal 175. Seal 175 assists in forming a vacuum-tight interface between manifold 172 and a lower surface of a respective one of media supports 146A, 146B. FIGS. 7 and 8 illustrate the boundaries of the chamber 173 formed by seal 175 with respect to an overlying media sport 146B (shown in FIG. 7) and with respect to an overlying media support 146A (shown in FIG. 8). Chamber 173 is in communication with vacuum source 68 (shown in FIG. 3), wherein vacuum is applied to each of vacuum ports 156.

Figure 4:
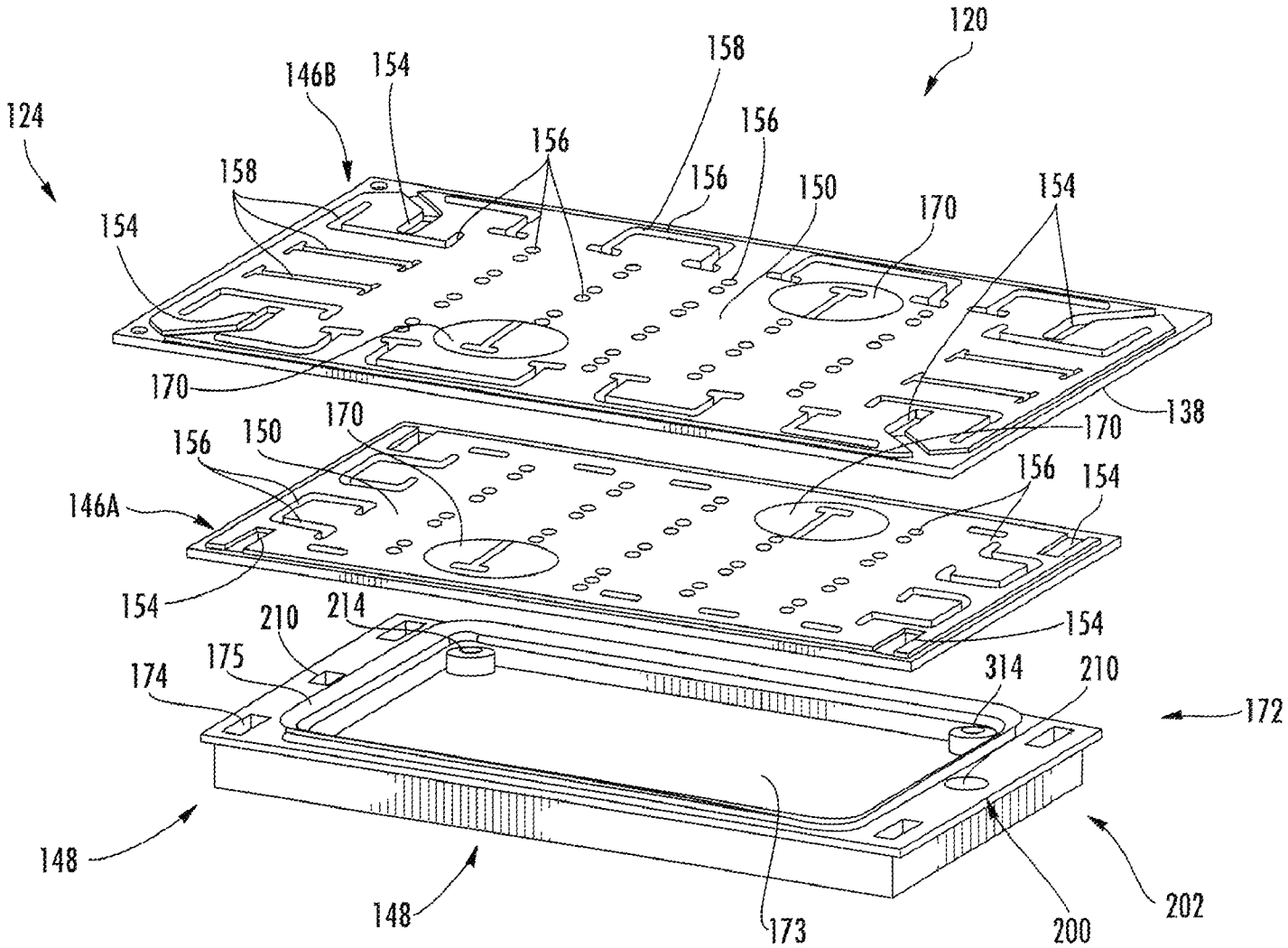
FIG. 4 is a top perspective view of a manifold and interchangeable media supports of another embodiment of the printing system of FIG. 1 according to an example embodiment.
Figure 5:
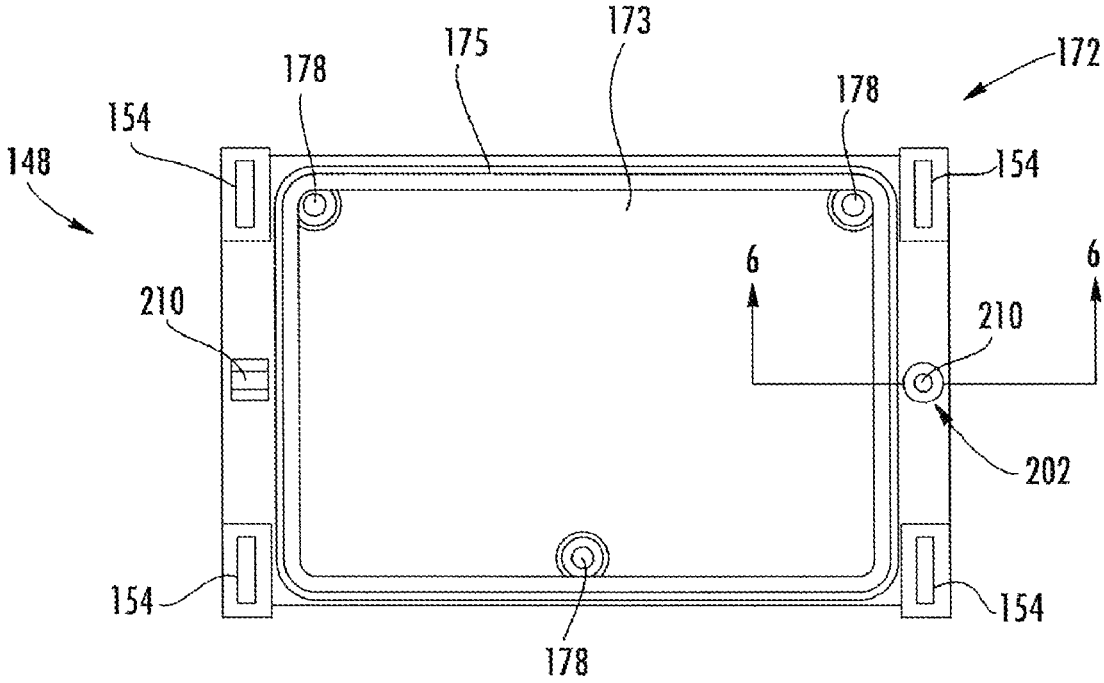
FIG. 5 is a top plan view of the manifold of FIG. 4 according to an example embodiment.
Figure 6:
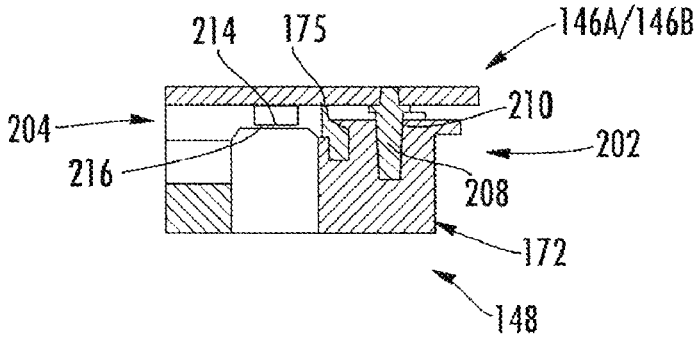
FIG. 6 is a sectional view of the manifold of FIG. 5 taken along line 6-6 with one of the media supports of FIG. 4 resting upon the manifold according to an example embodiment.

As further shown by FIGS. 4-6, media supports 146 and base 148 additionally include cooperating alignment features 200 and mounting features 202. Alignment features 200 assistant aligning supports 146 to manifold 172 and base 148. In the example illustrated, alignment feature 200 includes at least one alignment projection or pin 208 extending from an underside of in a respective media support at least one corresponding alignment detent or opening to 10 formed along a perimeter of manifold 172 of base 148. When one of supports 146 the position upon manifold 172, alignment pin 208 is received within opening 210 to properly align chamber 173 with respect to the overlying support 146A, 146B. In other embodiments, alignment features 202 may have other configurations.

Mounting features 204 assist in a mounting an associated one of supports 146 upon manifold 172 of base 148. In the particular example illustrated, mounting features 204 include spherical supports the role 214 provided on manifold 172 and planar contact surfaces 216 formed on an underside of each of media supports 146. As shown by FIG. 6, when one of supports 146 is positioned upon base 148, contacts 214 contact surfaces 216 to establish point contact. In the example illustrated, mounting features 204 includes three spherical supports 214 arranged in a triangular pattern on manifold 173 and three plainer contact surfaces 216 arranged in a corresponding triangular pattern. In other embodiments, mounting features 204 may include a greater or fewer of such contacts 214 and surfaces 216.

In the example illustrated, contacts 214 and surface 216 are additionally held to one another by magnetic forces. For example, in one embodiment, spherical supports 214 may comprise magnetic balls while planar contact surfaces 216 are formed of steel or other ferrous metal. In still other embodiment, contacts 214 may be formed from steel or other ferrous material while surfaces 216 are formed from magnetic material or are electromagnetic.

Figure 9:
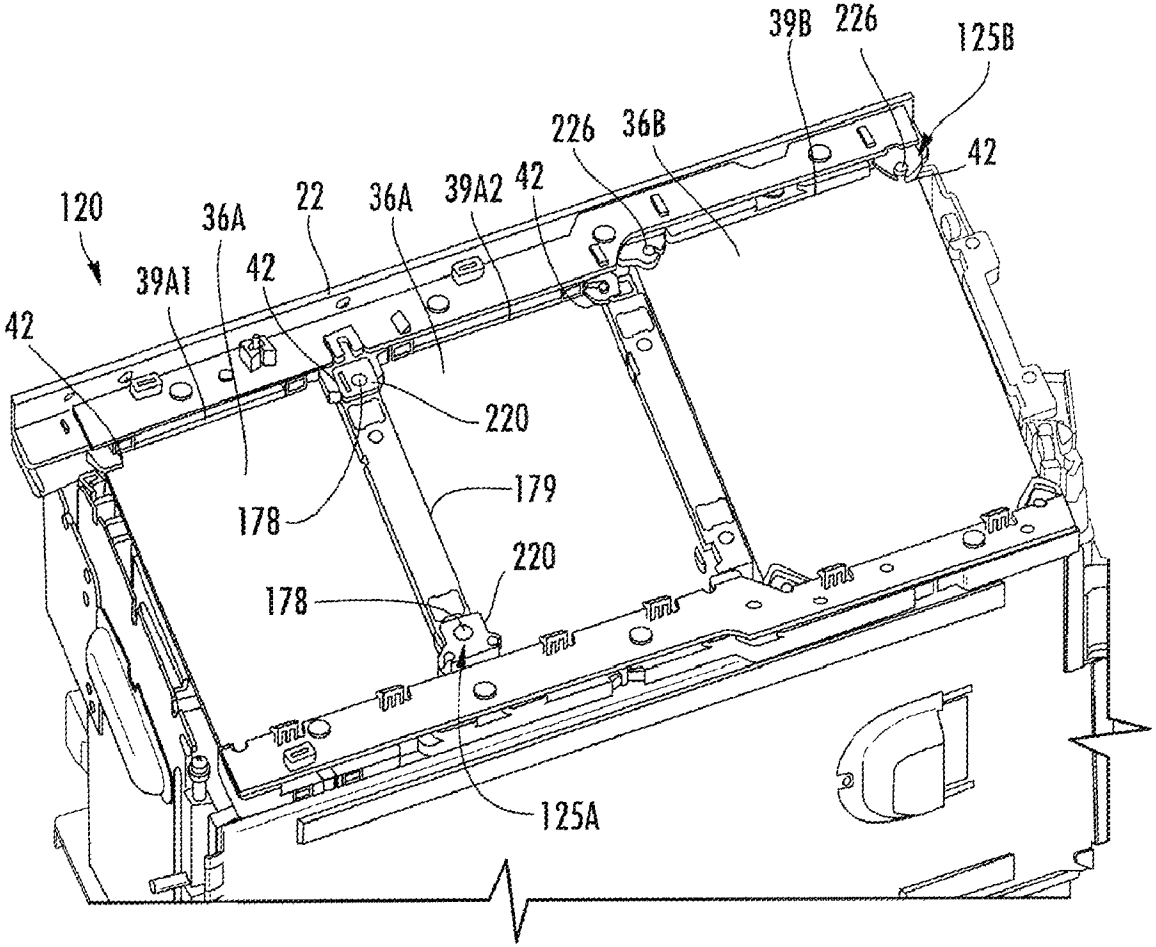
FIG. 9 is a top perspective view of parking spots of the printing system of FIG. 4 according to an example embodiment.
Figure 10:
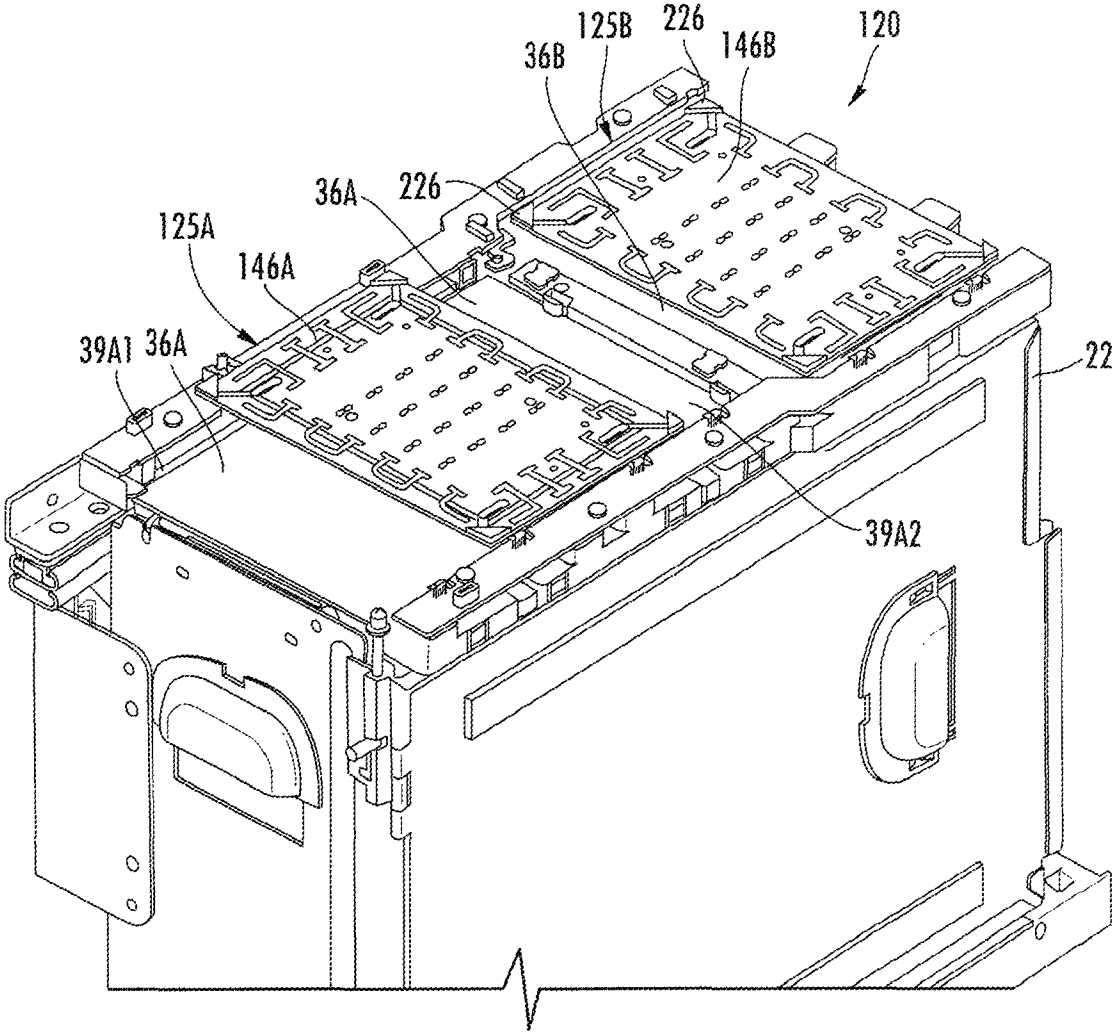
FIG. 10 is a top perspective view illustrating the media supports of FIG. 4 parked in the respective parking spots of FIG. 9 according to an example embodiment.

FIGS. 9-12 illustrate parking spots 125 of system 120. Parking spots 125 comprise one or more structures configured to support one or more of media supports 146 when such media supports 146 are not on base 48 and are not being used. Parking spots 125 extend along upper portions of sheet supply 22 and elevate or support media supports 146, when not in use, at least partially over and across stack cavities 39A and 39B. In particular, as shown by FIG. 10, parking spot 125A is configured to support media support 146A between and over adjacent similarly sized stack cavities 39A which are configured to receive stacks of sheets 36A. Parking spot 125B is configured to support media support 146B substantially over stack cavities 39B. Because parking spots 125 support their associated media supports 146 at least partially over stack cavities 39, valuable space in system 120 is preserved. At the same time, parking spots 125 facilitate access to and retrieval of unused media supports 146 by pick device 126 (shown in FIG. 13) for fast and efficient exchanging of differently sized media supports on base 148 without having to move pick device 126 along an additional path to retrieve a different media support 46 or to store and exchanged media support 146. In other words, parking spots 125 enable pick device 126 to use the same path to travel for both retrieving and storing media supports 146 and for picking both sizes of sheets 36A, 36B.

In the example illustrated, parking spots 125 include one or more retaining elements configured to secure and retain media supports 46 against horizontal movement when such support 46 are positioned at parking spots 125. For example, in one embodiment, retaining elements may comprise corresponding projections and detents that receive such projections to retain support 146 against horizontal movement.

Figure 11:
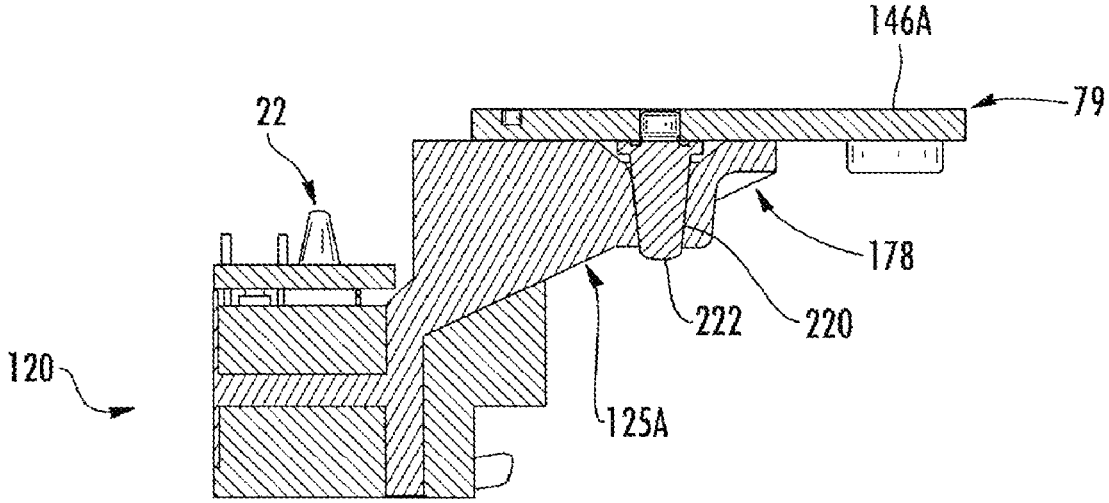
FIG. 11 is a sectional view of a first one of the media supports at its associated parking spot according to example embodiment.
Figure 12:
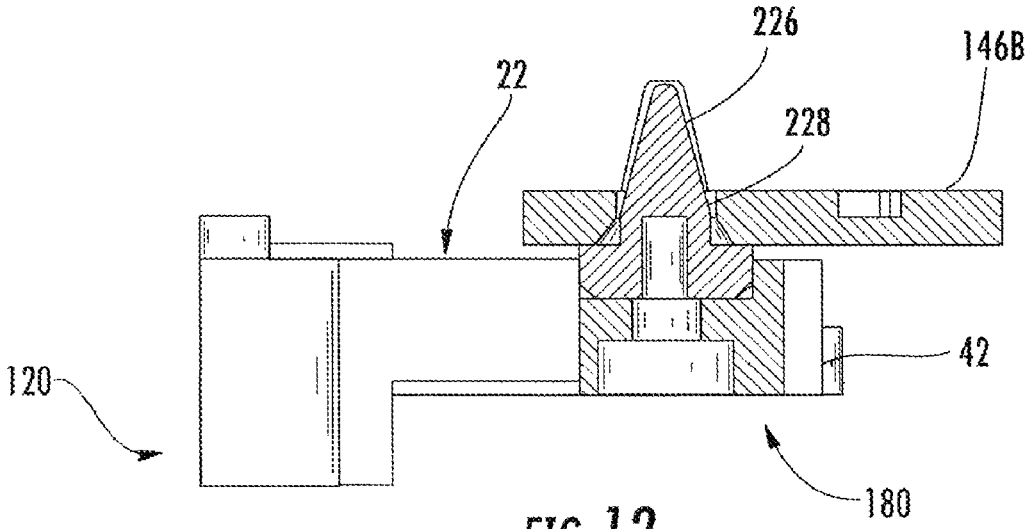
FIG. 12 is a sectional view of a second one of the media supports at its associated parking spot according to example embodiment.

As shown by FIGS. 9 and 11, parking spot 125A includes retaining elements 178 supported on an intermediate crossbeam 179 extending between the consecutive stack cavities 39A. As shown in FIG. 11, retaining elements 178 comprise locating holes or detents 220 configured receive corresponding projections 222 extending from a lower side of media support 146A. As shown by FIGS. 9 and 12, parking spot 125B includes a pair of retaining elements 180 above a pair of projections 42. As shown by FIG. 12, retaining elements 180 comprise projections, such as pin 226, configured to be received by a corresponding detent or opening 228 along an underside or through of media support 146B. In other embodiments, retaining elements 178 and 180 may have other configurations and may be provided at other locations.

FIGS. 13-16 illustrate pick device 126. Pick device 26 is further configured (1) to remove one of media supports 146A, 146B from base 48, (2) to position or park the removed the media support at the appropriate one of parking spots 125A, 125B, (3) to pick the other of media supports 146A, 146B from its parking spot 125A, 125B and (4) to position the other media support 146A, 146B upon base 148. As shown by FIG. 1, pick device 126 includes pick unit 182 and actuator 84 (shown and described with respect to FIG. 1). Pick unit 182 grasps or secures articles (sheets 36 or supports 146) and raises and lowers such articles with respect to sheet supply station 122, parking spots 125 and base 148 of shuttle tray 124. Pick unit 82 includes body 254, platform 255, vacuum source 256, vacuum cups 258, pressure member 260 having pressure surface 262, pushers 294 and support grabbers 296. Body 254 comprises a framework configured to support vacuum source 258 and to movably support platform 255. In the particular embodiment illustrated, at least one horizontal guide shaft (not shown) is slidably guides movement of body 254 in a substantially horizontal direction above sheet stacks 39. In other embodiments, body 254 may have other configurations for movably supporting the remainder of pick unit 182 in both vertical and horizontal directions.

Platform 255 comprises a structure vertically movable relative to body 254 along vertical guide rods 300 or other guides. Platform 255 supports, vacuum cups 258, pressure member 260, pushers 294 and grabbers 296 for movement in vertical and horizontal directions. Vacuum source 256 comprises a blower configured to draw air through vacuum cups 258. Vacuum cups 258 comprise bellows vacuum cups and are peripherally located about pressure member 260. In the particular example illustrated, pick unit 182 includes four vacuum cups 258 configured to apply vacuum to and grasp top surface 44 of an uppermost sheet 36 proximate to the corners of the uppermost sheet 36. In the particular example illustrated in which pressure member 260 is substantially rectangular or square, vacuum cups 258 are arranged proximate to each corner of pressure member 260. In the particular example illustrated, vacuum source 256 and vacuum cups 258 are configured to create a vacuum of about 20 inches Mercury when picking a sheet 36. Other suitable pressure levels for the vacuum may be alternatively employed. In other embodiments, pick unit 182 may have a greater or fewer of such vacuum cups, having the same or different configurations or having alternative locations with respect to pressure member 260.

Figure 13:
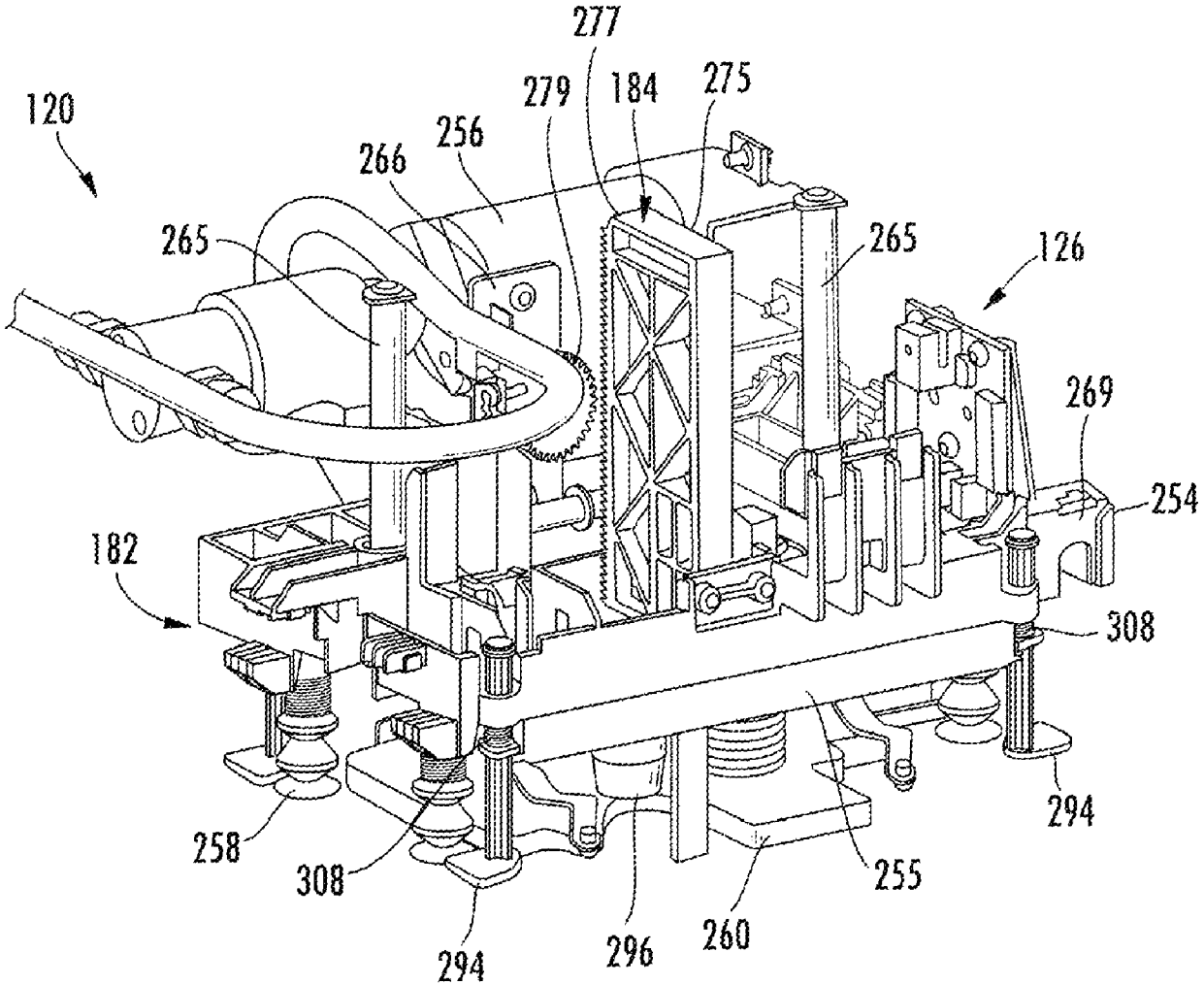
FIG. 13 is a top perspective view of a pick device of the printing system of FIG. 4 according to an example embodiment.
Figure 14:
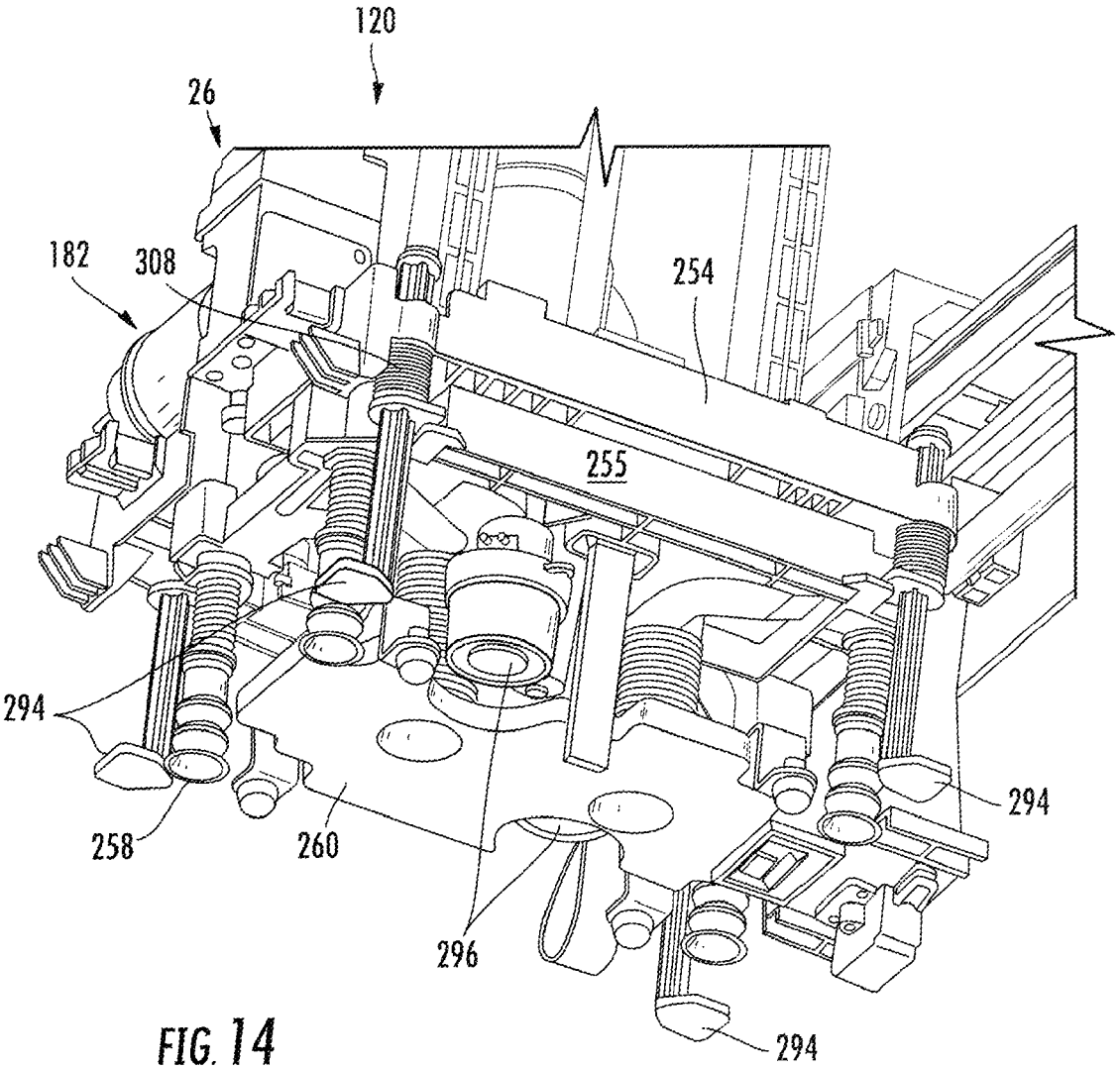
FIG. 14 is a bottom perspective view of the pick device of FIG. 13 according to an example embodiment.

Pressure member 260 comprises a structure movably supported relative to body 254 between an extended position in which surface 262 extends beyond a terminus of vacuum cups 258 and a retracted position in which surface 262 is equal or withdrawn relative to the terminus of vacuum cups 258 as seen in FIG. 13. As shown by FIG. 13, in the particular example illustrated, pressure member 260 is resiliently biased towards the extended position by compression springs 271. In other embodiments, other mechanisms may be used to resiliently bias pressure member 260 towards the extended position.

Figure 15:
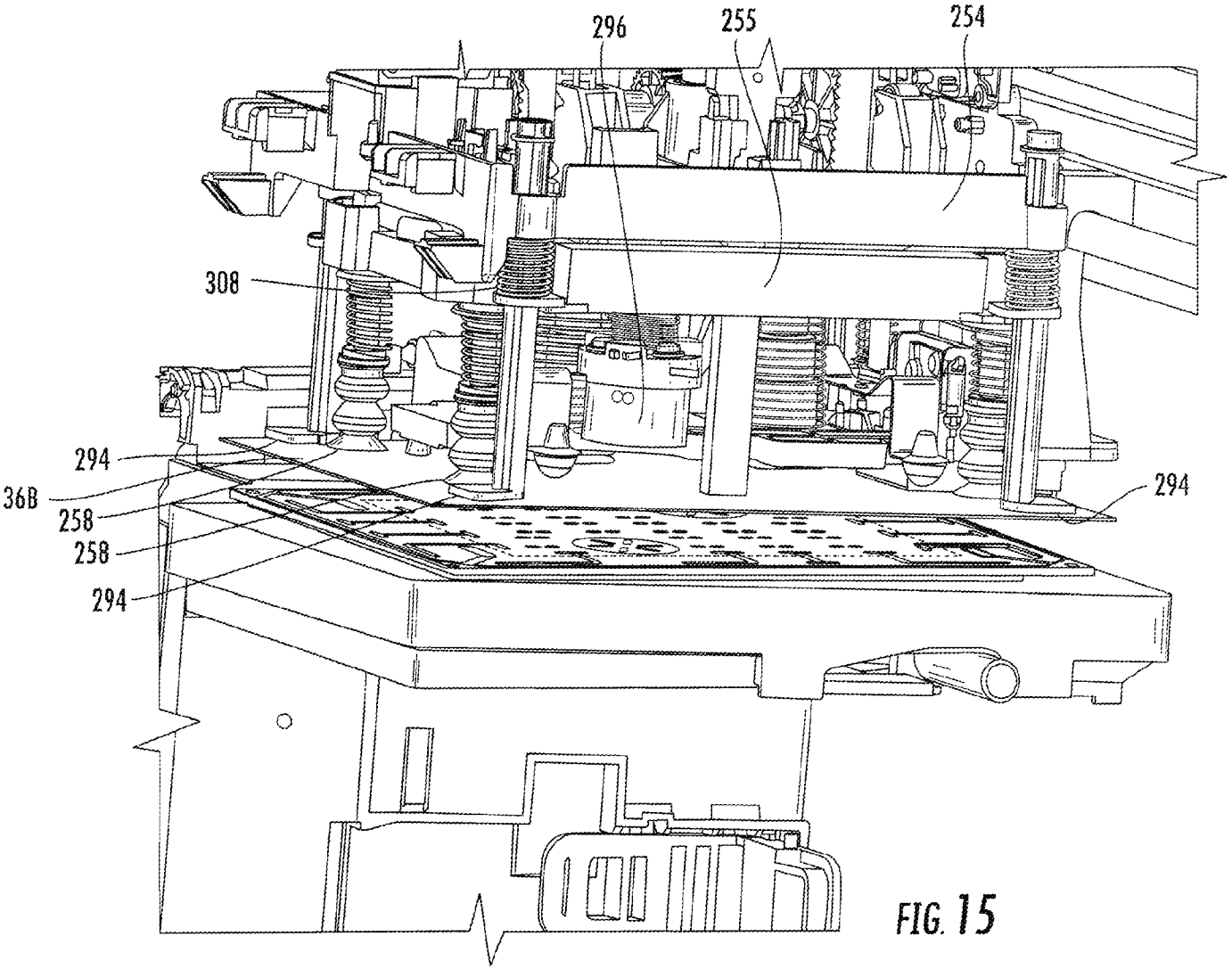
FIG. 15 is a perspective view of the pick device of FIG. 14 illustrating pushers of the pick device in a retracted position during transport of a sheet according to an example embodiment.
Figure 16:
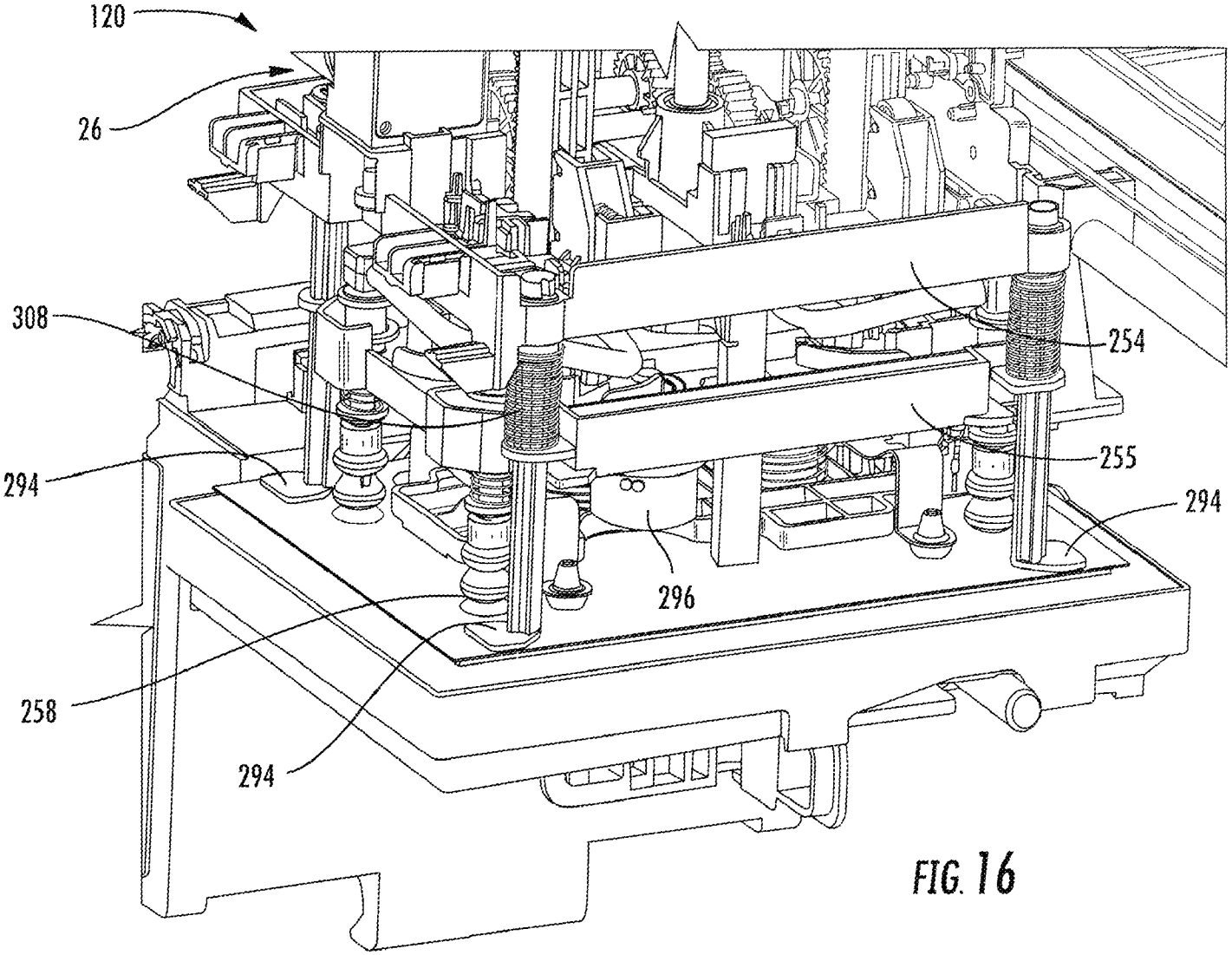
FIG. 16 is a perspective view of the pick device of FIG. 15 illustrating the pushers and an extended position pushing the sheet onto a media support according to an example embodiment.

Pushers 294 comprise feet or other structures movably supported by platform to 55 so as to move between a retracted position (shown in FIGS. 14 and 15) and an extended position (shown in FIG. 16). FIGS. 15 and 16 illustrate pick unit 182 positioning one of sheets 36B upon media support 146B. In the example illustrated, pushers 294 are resiliently biased by a spring 308 captured between body 254 and platform 255. In the retracted position, pushers 294 are withdrawn from a (top) face of a sheet 36B held by cups 258. In the extended position, pushers 294 engage and press against portions of the top face of the sheet 36B held by cups 258.

Pushers 294 are located to an outside of each of the suction cups 258. In other words, each pusher 294 is spaced from a center point between suction cups 258 by a distance greater than the distance at which the cup 258 most proximate to the pusher 294 is spaced from the center point. In the example illustrated, cups 258 are configured to engage surface portions proximate to corners of sheets 36A (shown in FIG. 2) while pushers 294 are outside the edges 38 of the smaller sheets 36A. However, pushers 294 are configured to engage surface portions of the larger sheets 36B outside cups 258. As a result, as shown by FIG. 16, during positioning of a sheet 36B upon media support 146B, pushers 294 press the outside corners of sheets 36B against media support 146B to enhance vacuum retention of the sheet 36B against the support 146B.

Support grabbers 296 comprise one or more mechanisms configured to secure or grip one of supports 146, enabling device 126 to lift and carry support 146A, 146B. According to one example embodiment, grabbers 296 comprise selectively actuatable electromagnets, which are magnetically attracted to pick portions 170 of supports 146 (shown in FIGS. 7 and 8). In such embodiments, the electromagnetic grippers may grasp supports 146 over portions of supports 146 which include vacuum ports or relief ports. In other embodiments, grabbers 296 may include suction cups. In yet embodiments, grabbers 296 may comprise other mechanisms configured to grab, grip or otherwise secure a support 146A, 146B for lifting and carrying of the support.

As shown by FIG. 13, pick actuator 184 includes a vertical lift 275 including a rack gear 277 coupled to platform 255 and a pinion gear 279 rotatably supported by a body 254 of system 120 and operably coupled to a torque source, such as a motor and an encoder (not shown). Selective rotation of pinion gear 279 raises and lowers gear 275 and platform 255. Raising and lowering of platform 255 raises and lowers vacuum cups 258, pressure member 260, pushers 294 and support grabbers 296.

Pick actuator 184 additionally includes a horizontal actuation component (not shown) coupled to main frame 266 and configured to slide body 254 along the horizontal guide shaft (not shown). In the particular example illustrated, the horizontal actuation component comprises a endless toothed belt and drive motor. In other embodiments, the horizontal actuation component of pick actuator 184 may comprise other mechanisms such as a hydraulic or pneumatic cylinder-piston assembly, an electric solenoid or a motor and transmission configured to convert rotational movement to linear movement.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a print device;

a shuttle transport movable relative to the print device;

a first stack cavity configured to receive a stack of first sheets having first dimensions; and a first parking spot proximate a top of the first stack cavity;

a pick device configured to selectively position a first media support on the shuttle transport and on the first parking spot at least partially over the first stack cavity.

2. The apparatus of claim 1, wherein the pick device includes suction cups configured to contact the first sheets proximate corners of the first sheets.

3. The apparatus of claim 2 further comprising:

a second stack cavity configured to receive a stack of a second sheets having different second dimensions, wherein the pick device includes pushers outside the suction cups and configured to contact the second sheets proximate corners of the second sheets.

4. The apparatus of claim 2, wherein each suction cup includes a vacuum port.

5. The apparatus of claim 1, wherein the first media support has a length of about 7 inches and a width of about 5 inches and wherein the second support has a length of about 6 inches and a width of about 4 inches.

6. The apparatus of claim 1, further comprising a base coupled to the transport, wherein the base includes a vacuum manifold and wherein the first support includes one or more vacuum ports.

7. The apparatus of claim 1, wherein the first parking spot includes one of a projection and a detent, wherein the first support includes the other of the projection and the detent and wherein the detent receives the projection.

8. The apparatus of claim 1 further comprising:

the first media support, wherein the first media support is configured to support one of the first sheets while being supported by the shuttle transport;

a second stack cavity configured to receive a stack of a second sheets having different second dimensions;

a second media support different from the first media support and configured to support one of the second sheets while being supported by the shuttle tray base;

a second parking spot proximate a top of the second stack cavity; and a shuttle tray base coupled to the shuttle transport, wherein the shuttle tray base includes a first detent, wherein the first support includes a first projection configured to be received within the first detent, wherein the second support includes a second projection configured to be received within the first detent and a second detent, wherein the first parking spot includes a third detent configured to receive the first projection of the first support and wherein the second parking spot includes third projection configured to be received within the second detent.

9. The apparatus of claim 8, wherein the first support has a first opening, wherein the second support has a second opening and wherein the shuttle tray base includes a lifter configured to pass through the first opening when the first support is positioned upon the shuttle tray base and to pass through the second opening with a second support is positioned upon the shuttle tray base.

10. The apparatus of claim 8, wherein the first support includes vacuum ports at a first outermost location with respect to a center of the shuttle tray base when the first support is upon the shuttle tray base and wherein the second support includes vacuum ports and a second grader outermost location with respect to the center of the shuttle tray base when the second support is upon the shuttle tray base.

11. The apparatus of claim 1, wherein the first support includes a ferrous portion and wherein the pick device includes a magnet.

12. A method comprising:

removing a first media support configured to support a first sheet of a first size from a shuttle tray base and parking the first media support at a first parking spot at least partially over a stack of first sheets; and removing a second media support configured to support a second sheet of a second size different than the first size from a second parking spot at least partially over a stack of the second sheets and positioning the second media support on the shuttle tray base.

13. The method of claim 12 further comprising picking a second sheet from the stack of second sheets and positioning the second sheet on the second media support.

14. The method of claim 13, wherein a single pick device is use to remove the first media support from the shuttle tray, to park the first media support at the first parking spot, to remove a second media support from the second parking spot, to position the second media support on the shuttle tray, to pick the second sheet from the stack of second sheets and to position the second sheet on the second media support.

15. The method of claim 12 further comprising:

transporting the shuttle tray base supporting the second sheet to a print device; and printing upon the second sheet with the print device.

16. The method of claim 12 further comprising unloading the first sheet from the first support an unloading thus second sheet from the second support using a single offload station.

17. The method of claim 12 further comprising:

holding the first sheet against the first support with a vacuum applied through a first set of vacuum ports in the first support; and holding the second sheet against the second support with a vacuum applied through a second set of vacuum ports in the second support, wherein the first set of vacuum ports are at a first outermost location with respect to a center of the shuttle tray base when the first support is upon the shuttle tray base and wherein the second set of vacuum ports are at a second greater outermost location with respect to the center of the shuttle tray base when the second support is upon the shuttle tray base.

18. The method of claim 12 further comprising positioning a projection associated with one of the first support and the first parking spot in a detent associated with the other of the first support and the first parking spot.

19. The method of claim 12 further comprising engaging the second sheet at each corner of the second sheet with a suction cup and a pusher outside the suction cup while lowering the second sheet onto the second support.

* * * * *